United States Patent [19]

Vickers

[11] 4,318,631

[45] Mar. 9, 1982

[54] TEXTURING BROOM APPARATUS FOR ROADWAY PAVEMENTS

[76] Inventor: Richard R. Vickers, 2012½ E. 7th St., Anderson, Ind. 46012

[21] Appl. No.: 113,771

[22] Filed: Jan. 21, 1980

[51] Int. Cl.[3] ..... E01C 23/16

[52] U.S. Cl. ..... 404/93; 56/400.16; 56/400.17; 56/375; 404/118

[58] Field of Search ..... 404/93, 118; 56/375, 56/400.16, 400.17; 15/105.52, 106, 159 R

[56] References Cited

U.S. PATENT DOCUMENTS

| | | | |
|---|---|---|---|
| 637,190 | 11/1899 | Whipple | 404/118 X |
| 663,288 | 12/1900 | Mason | 56/375 |
| 1,851,047 | 3/1932 | Kaposy | 56/400.17 |
| 1,869,647 | 8/1932 | Anderson | 56/400.17 |
| 2,055,986 | 9/1936 | Potemkin | 56/400.17 |
| 3,596,578 | 8/1971 | Jones | 404/93 |
| 3,605,579 | 9/1971 | Heltzel | 404/93 |
| 3,703,857 | 11/1972 | MacKinnon | 404/93 |

*Primary Examiner*—Nile C. Byers, Jr.
*Attorney, Agent, or Firm*—Meyer, Tilberry & Body

[57] ABSTRACT

A texturing broom apparatus for surface grooving freshly laid uncured concrete pavement comprising a traveling horizontal endless conveyor belt having a texturing broom, provided with a row of straight spring steel tines projecting from a base board in spaced apart side-by-side parallel relation, pivotally mounted on the conveyor belt for pivotal movement thereon in a vertical plane parallel to the direction of belt travel with the row of tines extending transversely across and outwardly from the belt and the tines disposed parallel to the longitudinal vertical plane of the belt. Spring means biases the pivoted broom forwardly of the direction of belt travel to a limiting idle position and the broom is supported on the belt in a position with its tines in a trailing working position disposed above and at a shallow working angle of less than about 20° to the pavement surface, during the travel of the broom along the lower run of the belt, and with the free ends of the tines spring-pressed into engagement with the surface of the uncured pavement to form the texturing grooves therein during the traverse of the broom thereacross. The tines of the texturing broom are clamped at one end to the broom base board by a metal strap extending transversely across the tine ends and secured to the base board by fastening screws on each side of each of the tines, and the spaces between the metal strap and base board at the gaps between the adjacent tines are filled with an epoxy adhesive.

15 Claims, 8 Drawing Figures

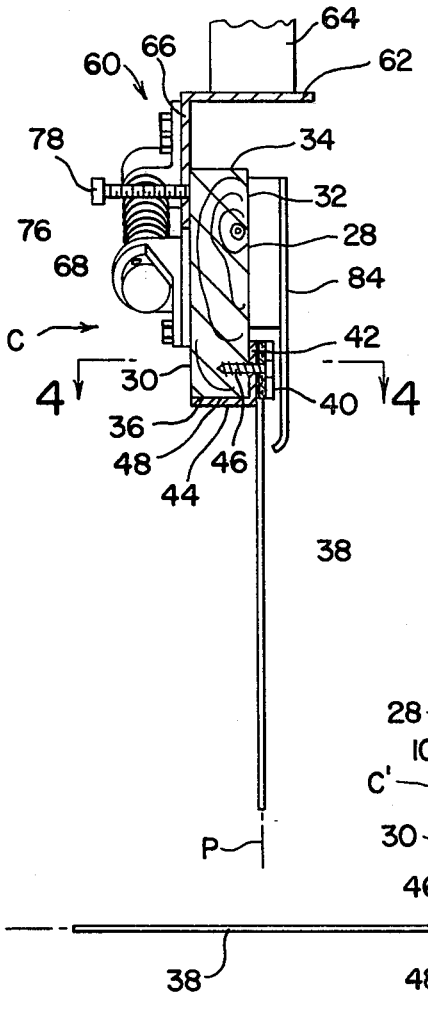
FIG. 2
FIG. 7
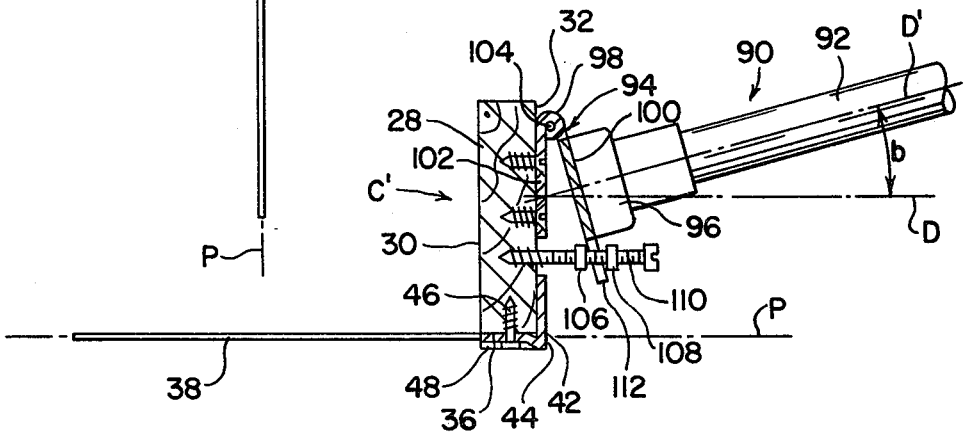
FIG. 8
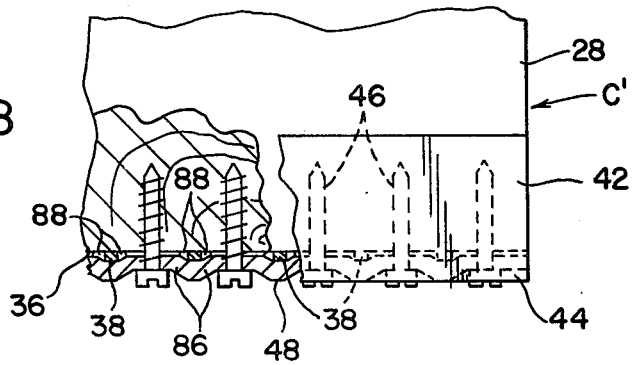

TEXTURING BROOM APPARATUS FOR ROADWAY PAVEMENTS

BACKGROUND OF THE INVENTION

This invention relates in general to texturing brooms and apparatus for surface texturing freshly laid uncured concrete or other like pavement such as used for roadways, for example.

In the formation of concrete and similar type roadway pavements, it is customary and generally governmentally required practice to texture the surface of the freshly laid uncured concrete pavement by drawing a stiff texturing broom thereacross to form shallow surface grooves in the pavement transverse to the intended normal direction of traffic thereon mainly for the purpose of providing an anti-skid pavement surface.

Pavement texturing machines are commonly employed for such purpose and comprise an endless conveyor belt which extends horizontally above and across the pavement surface and carries one or more texturing brooms provided with tines which are depressed into and form grooves in the pavement surface as the broom is drawn thereacross by the conveyor belt.

The texturing brooms conventionally employed heretofore on such pavement texturing machines have comprised an elongated base or header board member generally formed of two planed wood board sections secured flatwise together, as by means of fastening screws, with a row of straight, comparatively flexible spring steel tines clamped therebetween and projecting equidistantly from the longitudinal seam between the two board members in spaced apart parallel relation in a direction more or less normal to the longitudinal edge of the joined board members and disposed approximately in a common plane. The brooms have been supported on the pavement texturing machines with their tines extending at a steep and almost perpendicular angle to the pavement surface during their traverse thereacross by the conveyor belt. As a result, the straight flexible tines of the broom become severely deflected to a sharply curved shape during use owing to the force of the viscous concrete pavement initially pressing almost perpendicularly against the broom tines at the outset of each broom traverse of the pavement surface. This severe deflection of the comparatively flexible tines subjects them to a ripping effect which in some cases rips the tines completely out of and separates them from the header board. Moreover, besides there not being any effective means of applying downward pressure on the deflected flexible spring steel tines in order to obtain the required depth of the grooves needed to produce the anti-skid surface on the concrete pavement, the above-mentioned severe deflection of the tines also acts to permanently bend or distort many of the tines out of their original straight shape and parallel relation whereby they then become ineffective to perform proper texturing of the pavement due to the distorted tines either failing to contact the pavement at all or to form grooves of improper depth or spacing in the pavement. For the above reasons, therefore, the texturing brooms as employed on the prior art pavement texturing machines have had comparatively short service life and have required either frequency replacement or repair.

SUMMARY OF THE INVENTION

The present invention contemplates a new and improved pavement texturing apparatus for surface texturing freshly laid concrete or like roadway pavements which overcomes all of the above referred to problems and others and the texturing brooms of which have a comparatively long service life such as obviates the need for frequent machine shutdown for broom replacement or repair.

In accordance with the present invention, there is provided a pavement texturing apparatus having one or more texturing brooms supported thereon provided with more durable tines than employed heretofore and with their respective row of tines so positioned as to lie in a trailing operative pavement-texturing working position relative to the pavement surface with the plane of the tines disposed at a shallow working or approach angle of less than about 20° to the pavement surface. As a result, the contact force of the pavement-retaining metal side forms against the tines at the outset of each traverse of the pavement by the broom, as well as the pressure of the viscous concrete of the pavement itself against the tines during their traverse of the pavement, is applied to the tines generally in a direction longitudinally thereof so as to minimize the distortion of the tines and the likelihood of their being ripped out of and separated from the broom header board. Also, the necessary downward pressure can be applied to the tines to produce the required depth of the grooves in the pavement surface.

In accordance with a further aspect of the invention the tines of the texturing broom are each secured at one end of the base or header board of the broom by a somewhat bendable metal fastening strap disposed along the header board and overlying and bent around the tines and secured to the header board by fastening screws on each side of each of the tines, with epoxy or other like adhesive composition filling the spaces between the metal fastening strap, header board and the tines.

The principal object of the invention is to provide a pavement texturing apparatus for surface texturing freshly laid uncured concrete or like roadway pavements with shallow surface grooves which apparatus will produce a more uniform and superior textured surface finish than, and extend the useful service life of the texturing broom component thereof over that provided by prior type pavement texturing apparatus.

Another object of the invention is to provide an improved pavement texturing apparatus as referred to above the tines of the texturing broom of which are not subject to being ripped out and separated from their supporting base member or to being permanently bent or distorted out of their original shape and position relative to one another during the normal use of the apparatus.

Still another object of the invention is to provide a pavement texturing broom adapted for use in pavement texturing operations and having a considerably increased useful service life over that of prior type texturing brooms employed for such purposes.

A further object of the invention is to provide a pavement texturing broom affording controlled adjustable downward pressure on the tines thereof during use, to obtain the required depth of the grooves in the pavement surface with the use of the more durable spring steel tines than those conventionally employed heretofore.

BRIEF DESCRIPTION OF THE DRAWINGS

Further objects and advantages of the invention will appear from the following description of a preferred species thereof and from the accompanying drawings in which:

FIG. 2 is a sectional view on the line 2—2 of FIG. 1;

FIG. 7 is a side view on an enlarged scale, shown partly in section on the line 7—7 of FIG. 6; and FIG. 8 is a fragmentary rear elevation on an enlarged scale of the texturing broom shown in FIGS. 5–7.

DESCRIPTION OF THE PREFERRED EMBODIMENTS

Figure 3:
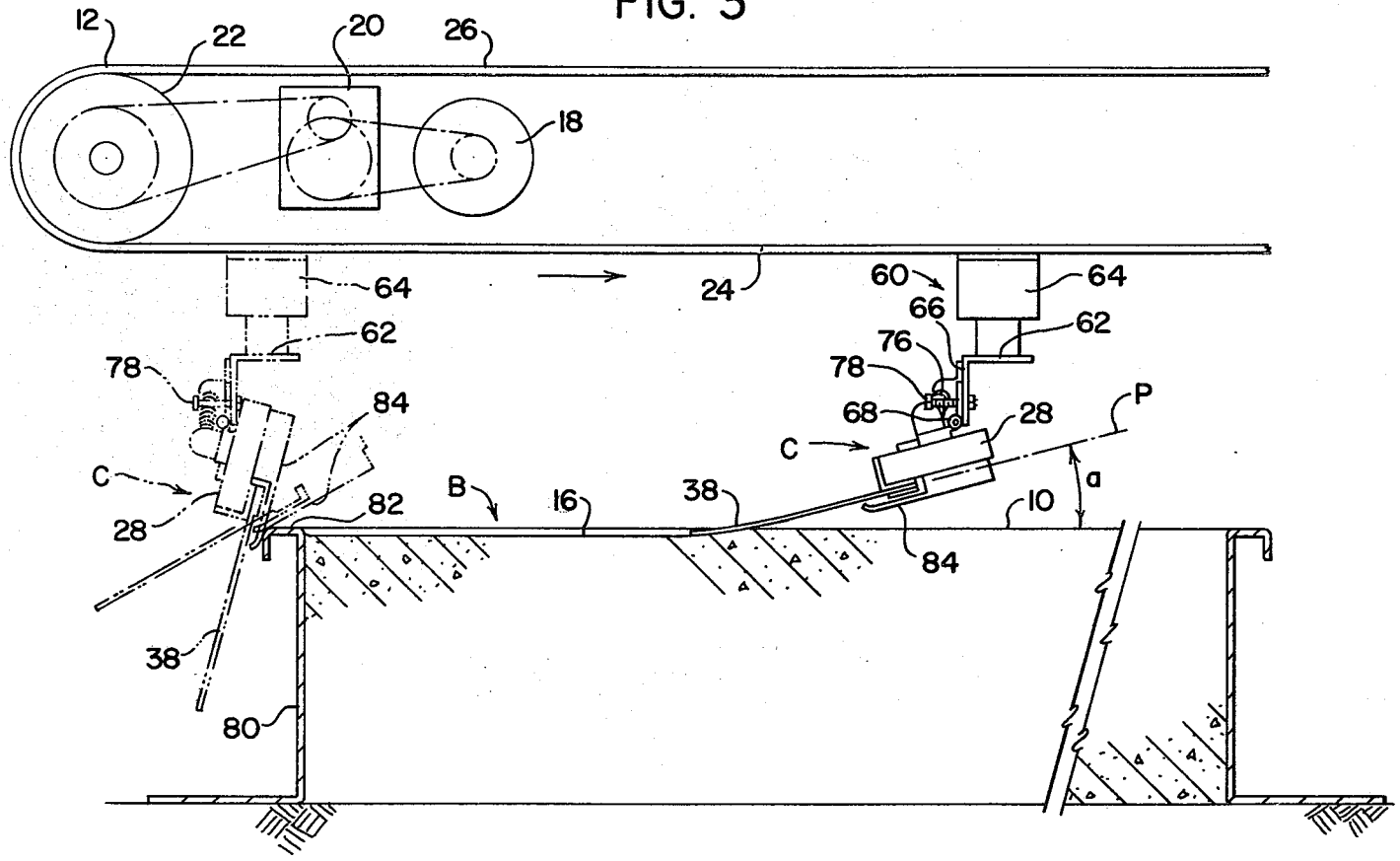
FIG. 3 is a side elevational view of the pavement texturing apparatus comprising the invention shown in operative surface texturing position relative to the surface of a freshly laid concrete pavement to be textured.

Referring now to the drawings wherein the showings are for the purpose of illustrating preferred embodiments of the invention only and not for the purpose of limiting same, the FIGURES show a roadway pavement surface texturing apparatus A according to the invention shown positioned in FIG. 3 in operative surface-texturing relation to the surface 10 of a freshly laid and as yet uncured concrete or like roadway pavement B or to an overcoating thereon of a synthetic resin material. The texturing apparatus A comprises a horizontally extending endless conveyor belt 12 which is positioned to overlie and extend across and beyond the ends of the full extent of the freshly laid pavement B to be textured, and it carries one or more texturing brooms C each provided with a row of spring steel tines 38 projecting equidistantly therefrom. In the normal use of the texturing apparatus A, the moving conveyor belt 12 draws the texturing broom C across the surface 10 of the pavement B with the tines 38 of the broom spring-pressed downwardly into trailing engagement with the pavement surface 10 so as to depress the free ends of the tines into the pavement surface and form shallow surface grooves 16 therein extending more or less transversely to the intended normal direction of traffic thereon, for the purpose of providing among other things a somewhat roughened and therefore an anti-skid pavement surface such as commonly required by governmental regulations.

The conveyor belt 12 is intermittently advanced to traverse broom C across the pavement surface 10 by any suitable power drive means such as an electric motor 18 which rotatably drives, through a speed reducer 20, one of the cylindrical drums or pulley wheels 22 over which the conveyor belt 12 runs. The conveyor belt is preferably provided with two of the texturing brooms C mounted on the belt equidistantly apart along the length thereof so that the belt carries the first one of the texturing brooms C along the lower run 24 of the conveyor belt and across the pavement surface 10 to thereby effect the texturing or grooving thereof while the other or second texturing broom C is at the same time carried by the belt along the upper run 26 thereof and advanced into position for the start of its ensuing traverse of the pavement surface 10. It should be understood, however, that this traverse of the pavement surface 10 by the second texturing broom C occurs only after the entire pavement texturing apparatus A has been bodily shifted lengthwise of the pavement B, upon completion of the traverse of the first texturing broom C across the pavement surface 10, the proper distance to position the second texturing broom in line with the next strip of pavement B to be textured. This bodily shifting or indexing of the entire pavement texturing apparatus A lengthwise of the roadway pavement B can be performed, of course, either during intermittent idle or dwell periods of the conveyor belt 12 during each of which periods the advance movement of the belt is temporarily halted, or it can be performed while the movement of the conveyor belt 12 is continued, depending of course on there being a sufficient time interval for such longitudinal indexing to be completed following the termination of the traverse of the pavement surface 10 by one of the texturing brooms C and the engagement of the pavement surface by the other texturing broom C on the indexed belt 12.

The texturing broom C comprises a body or header board 28 of a suitable hardwood and a size, for example, of around $\frac{3}{4}''$ thick by 4″ wide and anywhere from 24′ to 36″ or more in length, and having parallel flat side surfaces 30, 32 and parallel fat side edges 34, 36 extending along the length of the header board. A plurality of elongated straight spring steel tines 38 are supported each at one end in a row on the header board 28 to project approximately equidistantly from one of its side edges (bottom edge 36 in the particular case illustrated) in side-by-side uniformly spaced apart parallel relation to each other and disposed in a common plane P (FIG. 2). The tines 38 may have a cross-sectional size of, for instance, $\frac{1}{8}''$ width of 0.060″ thickness and a uniform length from 6″ to 8″ or so, and they may be spaced apart on their centerlines a distance of, for example, around $\frac{3}{4}''$ or so, or at whatever spacing, such as in a recurring pattern of varied tine spacing, that may be required by applicable pavement construction regulations specifying the spacing of the grooves 16 to be formed in the pavement surface 10.

Figure 1:
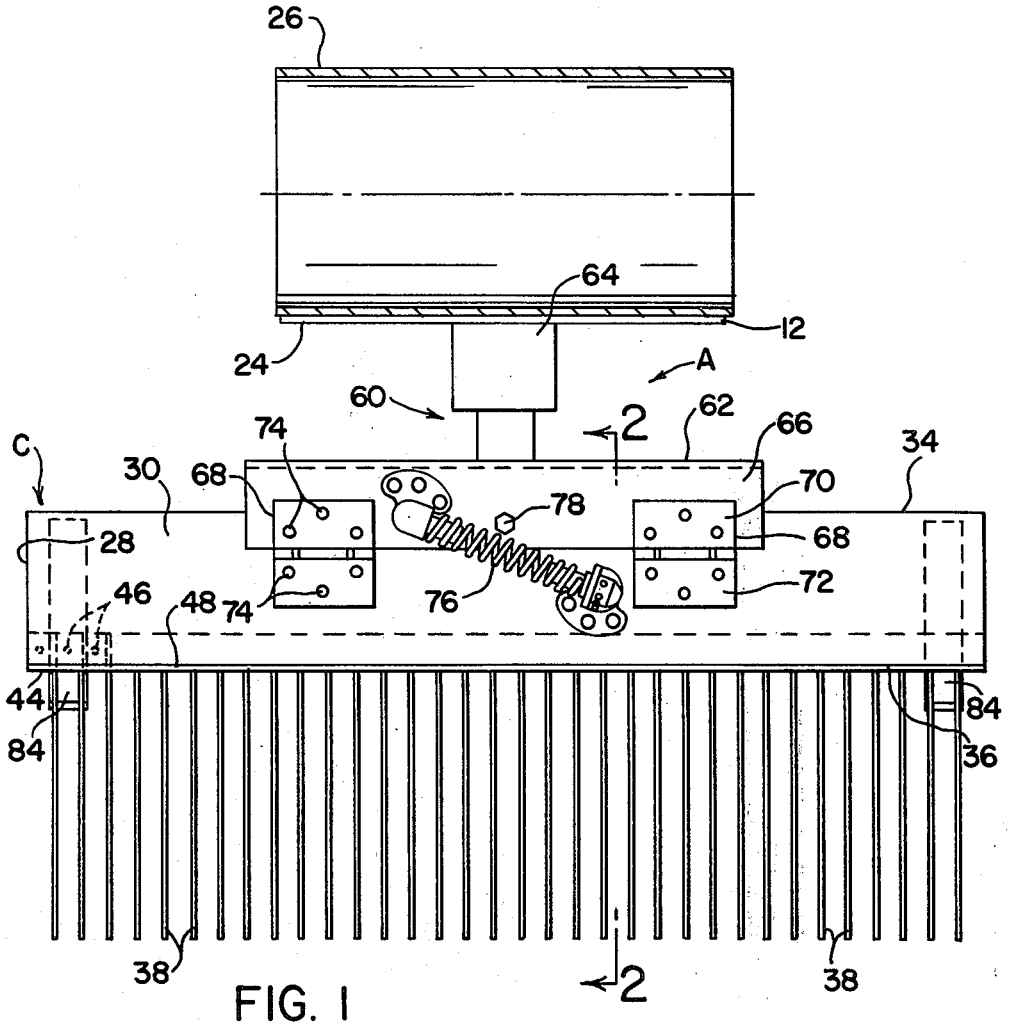
FIG. 1 is a partial front end elevational view of a pavement texturing apparatus comprising the invention.
Figure 4:
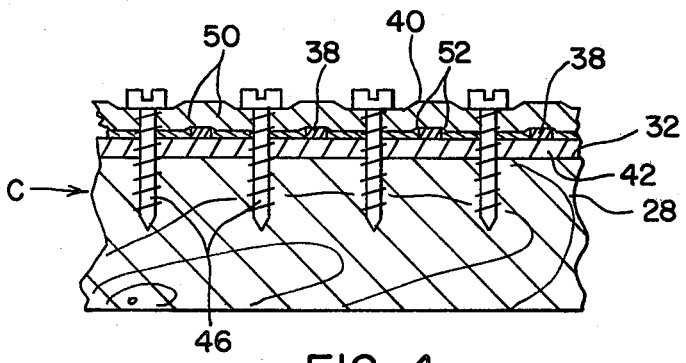
FIG. 4 is a cross-sectional view on the line 4—4 of FIG. 2.

The tines 38 are mounted on the header board 28 in a position to project from the bottom side edge 36 of the board in a direction normal to such edge 36 and parallel to flat side surfaces 30, 32 of the header board, and with the flat sides of the tines disposed parallel to, i.e., flatwise relative to the flat rear side surface 32 of the header board. The tines 38 are secured at one end to the header board 28 by being clamped between an elongated metal fastening strap 40, such as a 1″ wide by $\frac{1}{8}''$ thick aluminum strip, and the flange 42 of an elongated angle strip member 44, by fastening means such as screws 46 which screw into the header board and fasten the strap 40, tines 38 and angle strip member 44 to the rear side 32 of the header board with the flanges 42 and 48 of the angle strip member engaged with the rear side face 32 and the bottom side edge 36, respectively, of the header board. The fastening strap 40 is secured to the header board 28 at each side of each tine 38 by respective ones of the fastening screws 46 to thereby securely clamp the underlying ends of the tines 38 to and hold them in proper place on the header board. The fastening screws 46 may act, on tightening, to bend and clamp the fastening strap 40, if somewhat distortable, inwardly and partly around each side of each of the tines 38, as shown at 50 in FIG. 4, so as to assure the tight clamping of the tines to the angle strip member 44 and header board 28 and hold them in place thereon against twisting out of their parallel relation to one another. Also as shown in FIG. 4, the tines 28 are further held in place on the header board 28 against twisting as well as being pulled longitudinally out from between the fastening strap 40 and the flange 42 of the angle strip member 44 and thus being separated from the header board, by fillings 52 of a suitable epoxy or similar adhesive material filling the spaces between the fastening strap 40 and the flange 42 of angle strip member 44. The epoxy fillings 52 may also completely embed the bed portions of the tines 38 clamped between the fastening strap 40 and the flange 42 of the angle strip member 44.

In accordance with the invention, the texturing broom C is supported in place on the conveyor belt 12 is a position such that, during the traverse of the surface 10 of the roadway pavement B, the broom is disposed in an operative pavement texturing or working position (shown in solid lines in FIG. 3) relative to the surface 10 of the pavement B to be textured with the tines 38 of the broom trailing behind the header board 28 and positioned with their plane P inclined at a shallow working or approach angle a of less than 20°, and preferably ranging from about 10° to about 15° or so, to the approximately horizontal roadway surface 10. The particular broom supporting means 60 illustrated comprises a bracket member 62 attached to a mounting arm 64 on the conveyor belt 12 and having a depending flange 66 on which the broom C is pivotally mounted to swing or pivot in a vertical plane extending longitudinally of the conveyor belt 12. The broom C is mounted on the flange 66 of the bracket 62 by a pair of spaced double leaf hinges 68 the leaves 70 and 72 of which are respectively fastened, as by means of fastening bolts 74, to the bracket flange 66 and to the front side face 30 of the header board 28 of broom C with the pivot axes of the two hinges extending horizontally and coincident with one another. Hinges 68 mount the header board 28 for vertical swing movement about the coincident horizontal axes of the two hinges 68 in a vertical plane extending longitudinally of the conveyor belt 12 and normal to the header board and parallel to the tines 38 thereon.

The pivoted texturing broom C is spring-biased to pivot in a direction forwardly of the direction of travel of the conveyor belt 12 toward a predetermined limiting forwardly pivoted idle position as shown in dash-dot lines in FIG. 3, with the tines 38 extending in a direction generally perpendicularly outward of the belt 12, by spring means 76 comprising an adjustable torsion helical gate spring spanning the hinge axis of the hinges 68 and having its opposite ends fixedly secured to the depending flange 66 of bracket 62 and the header board 28 of the broom at opposite sides of the hinge axis. The idle position of the texturing broom C is the position which it assumes when it first disengages from the pavement surface 10 following the completion of each traverse thereof and in which position it remains during its travel throughout the upper run 26 of the conveyor belt and until it once again engages with the concrete pavement B at the outset of its next traverse thereof following the bodily shifting or index of the entire texturing apparatus A longitudinally of the roadway pavement B to align the broom C with the next section of the pavement surface 10 to be traversed. The spring-biased forwardly pivoted limiting idle position of the broom C is determined by the engagement of the spring-biased broom with a suitable adjustment means such as an adjustable stop bolt 78 screw-threaded into the flange 66 of bracket 62 and projecting therethrough for engagement with the heel end of the broom header board 28. The adjustment bolt 78 is preferably adjusted to a position to set the broom C in a predetermined limiting idle pivoted position on the conveyor belt 12 as shown in dash-dot lines in FIG. 3, with the broom in a slightly rearwardly pivoted position and its tines 38 trailing at a slight angle from a position perpendicularly of the conveyor belt.

At the outset of each traverse movement or draw of the texturing broom C across the concrete roadway pavement B by the conveyor belt 12 to form the texturing surface grooves 16 in the pavement surface 10, the advancing texturing broom C which at such time is positioned in its predetermined slightly rearwardly pivoted idle or non-working position as shown in dash-dot lines in FIG. 3, first engages the metal side form member 80 of the conventional retaining form customarily employed for such concrete pavements B. The form member 80 then pivots or swings the advancing broom C rearwardly and upwardly, against the spring-biasing pressure of the adjustable torsion gate spring 76, until the broom is swung up to a nearly horizontal position, slightly beyond its previously mentioned working position (shown in solid lines in FIG. 3) wherein the plane P of the tines 38 extends at a shallow angle of less than 20° to the pavement surface 10, to enable the broom C to clear and pass over and across the upper flange 82 of the side form member 80. In this connection, the conveyor belt 12 and broom supporting means 60 thereon are arranged to support the pivoted broom C and locate its hinge axis at the proper elevational level, above the upper flange 82 of member 80 and above the pavement surface 10 which is normally substantially level with the flange 82, to assure the rearwardly upward pivoting of the broom C by the flange member 80 to approximately its aforementioned working position.

To prevent the tines 38 of the broom C and their fastening strap 40 and angle strip member 44 from catching on the upper flange 82 of the side form member 80, during the engagement of the broom with and its rearwardly upward pivoting by the flange 82, such as would then stop the continued traverse movement of the broom across the flange 82 and pavement surface 10 and so interrupt the operation of the texturing apparatus A, the header board 28 of the broom C may be provided with suitable slide means such as a pair of slide shoes 84 mounted on the rear face 32 of the header board 28 adjacent its opposite ends for sliding engagement with and smooth riding of the broom C over the corner of the upper flange 82 on the form member 80. The slide shoes thus assure the continued uninterrupted operation of the texturing apparatus A when in use.

As soon as the free ends of the spring steel tines 38 of the broom C clear and pass beyond the upper flange 82 of the flange member 80, during the continued traverse movement of the broom across the pavement surface by the moving conveyor belt 12, the pressure of the torsioned gate spring 76 then pressing downwardly against the pivoted broom C acts to pivot it downwardly a slight amount to engage and press the free or tip ends of the tines 38 downwardly against the freshly laid and as yet uncured pavement surface 10, causing the tine ends to flex slightly and depress into the viscous concrete pavement surface 10 to form the texturing grooves 16 therein. It will be appreciated that the depth of the grooves 16 thus formed in the pavement surface 10 is dependent, in part, on the force of the adjustable torsion gate spring 76 acting against the broom and the consistency or relative viscosity of the pavement surface 10, and these two factors are taken into account by the workmen operating the pavement texturing apparatus A, e.g., by adjusting the torsion and thus the biasing force of the gate spring 76. In general, however, these two factors are controlled so that grooves 16 of the required depth, for instance, around $\frac{1}{8}''$ or so depth, are formed in the pavement surface 10 by the texturing broom C.

Upon completion of its traverse of the pavement B by the conveyor belt 12 and passage beyond the far end of the pavement and the pavement form member thereat, the texturing broom C is then pivoted downwardly and forwardly by spring 76 to its idle non-working position on the belt (shown in dash-dot lines in FIG. 3) in readiness for the next draw of the broom across the pavement surface 10 following the bodily shifting of the entire pavement texturing apparatus A longitudinally of the roadway pavement B to align the broom C with the next section of the pavement surface 10 which is to be textured by that particular broom.

By constructing the texturing broom C and its conveyor mounting in the manner as described above so that the tines 38 of the broom are supported in a trailing position and in a plane P inclined at a very shallow angle a from about 10° to about 15° or so relative to the surface 10 of the concrete pavement B to be textured, the appreciable forces applied by the viscous concrete of the pavement to the tines 38 during the texturing operation are directed nearly longitudinally along the length of the tines instead of normal thereto such as occurs with the prior art texturing brooms at the outset of each draw of the texturing broom across the pavement surface. As a result, there is considerably less likelihood of the tines 38 of the broom C in the apparatus A comprising the invention being bent or distorted out of shape or parallelism, or of being ripped entirely out of and separated from the header board 28. Thus, the texturing broom C and pavement texturing apparatus A according to the invention act to produce more uniform textured surfaces on concrete roadway pavements throughout a considerably longer surface life of the texturing broom, and fewer work stoppages of the texturing apparatus A are required for necessary replacement or repair of the texturing broom thereon.

FIGS. 5–8 illustrate a modified form of texturing broom C′ comprising the invention adapted for manual use in texturing freshly laid concrete pavement B to form the texturing grooves 16 therein. The modified broom C′ differs in part from the broom C of FIGS. 1–4 in that the tines 38 are mounted on the body or header board 28 in a position projecting therefrom in a direction parallel to the side edge 36, and normal to the side face 30 of the header board, instead of parallel to the rear side face 32 and normal to the side edge 36 of the header board as in FIGS. 1–4. Also, the tines 38 are secured at one end to the header board 28 by being clamped flatwise against the flat side edge 36 of the header board by means of the flange 48 of angle strip member 44 which has, for example, 1 inch wide by $\frac{1}{8}$ inch or so thick side flanges 42 and 48 and is formed of a suitable metal such as aluminum, for instance. The fastening angle strip member or strap 44 is secured to the header board 28 along and adjacent the side edge 36 thereof with one of its angle side flanges, i.e., flange 42, engaging flatwise against the flat rear side 32 of the header board and its other angle side flange 48 extending across and overlying the ends of the tines 38 which extend across the side edge 36 of the header board. The side flange portion 48 of the fastening angle strip member 44 is secured to the header board 28 at each side of each tine 38 by suitable fastening means, such as fastening screws 46 which are screwed into the header board 28, to thereby securely clamp the underlying ends of the tines 38 to and hold them in the proper place on the header board. In this connection, the fastening screws 46 may act to bend and clamp the side flange portion 48 of the fastening strap 44, if somewhat distortable, inwardly toward the header board and partly around each side of each of the tines 38, as shown at 86 in FIG. 8, so as to assure the tight clamping of the tines to the header board and hold them in place thereon against twisting out of their parallel relation to each other. Also as in FIGS. 1–4, the tines 38 are additionally held in place on the header board 28 against twisting, as well as against being pulled longitudinally out from between the fastening strap 44 and header board 28 and thus separated therefrom, by fillings 88 of a suitable epoxy adhesive material filling the spaces between the fastening strap flange 48 and the header board 28 at each side of each tine 38, as shown in FIG. 8. The epoxy adhesive 88 may also competely embed the end portions of the tines 38 clamped against the header board 28 by the fastening strap 44. In addition, the epoxy adhesive may extend between the fastening strap flange 48 and header board 28 at the regions where the fastening strap flange 48 is clamped by the fastening screws 46 to the header board.

Figure 5:
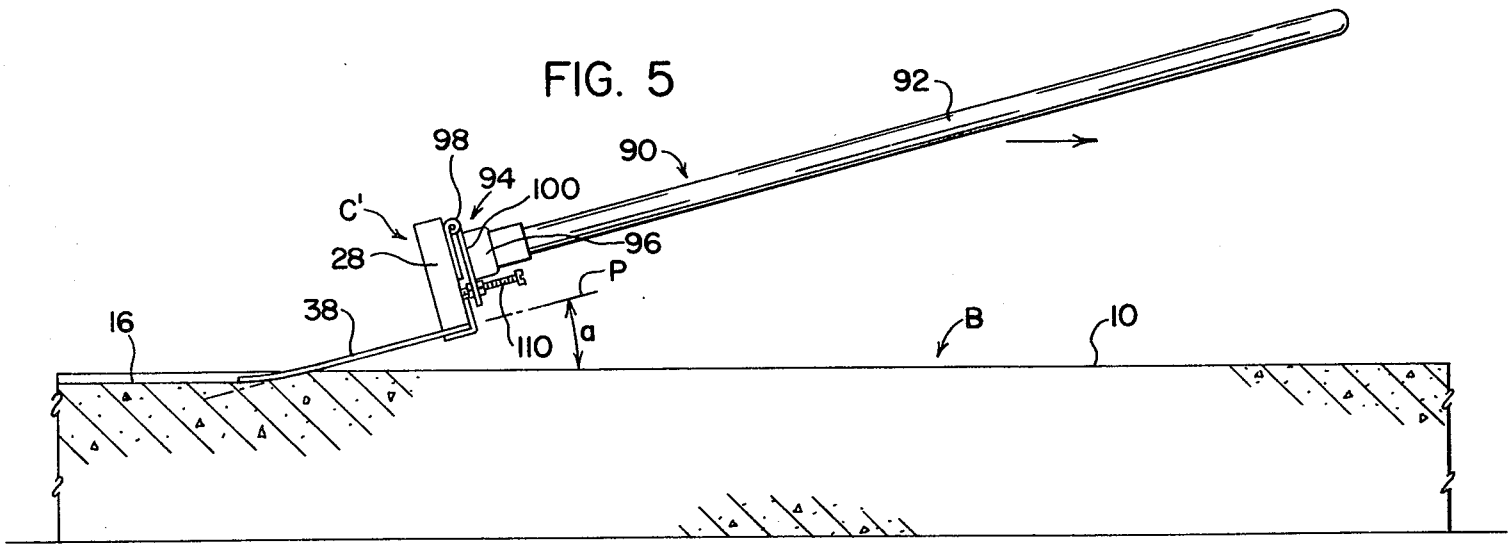
FIG. 5 is a side elevation of a texturing broom comprising the invention for manual use, shown in operative surface texturing position relative to the surface of a concrete roadway pavement.
Figure 6:
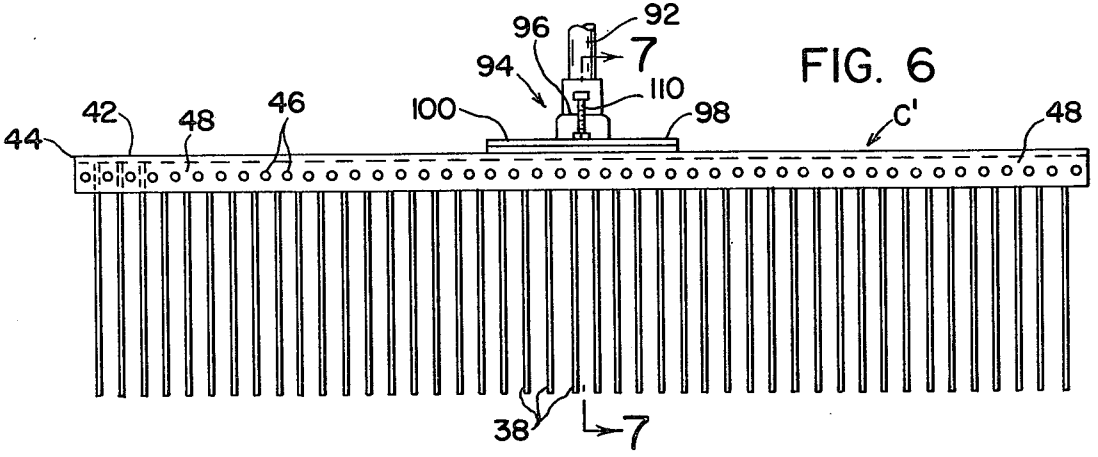
FIG. 6 is a bottom plan view of the texturing broom shown in FIG. 5.

As shown in FIG. 5, the texturing broom C′ is provided with supporting means 90 which, in accordance with the invention, is adapted to support the broom, when held in normal operating position by a workman, in the aforementioned operative pavement-texturing position, relative to the surface 10 of the pavement B to be textured, in which the tines 38 are positioned with the plane P thereof inclined at a shallow working or approach angle a of less than 20° and preferably ranging from about 10° to 15° or so to the pavement surface 10. In the form of the invention shown in FIGS. 5–8, the supporting means 90 comprises an elongated pole-like handle 92 of aluminum or other suitable material fastened at one end to the rear side 32 of the header board 28 for manual holding of the broom C′ by a workman during the pavement texturing operation. The pole handle 92 is mounted on the header board 28 to extend rearwardly therefrom in a given direction generally parallel to and opposite the direction in which the tines 38 extend from the board 28 rather than more or less perpendicularly to the tines as in the case of the prior art texturing brooms. Due to the shallow working angle at which the tines 38 of the broom C′ are held during the pavement texturing operation, and the use of the more durable tines, increased downward pressure can be exerted by the workman on the broom C′ and thus by the tines 38 against the concrete pavement, as necessitated by the varying degree of stiffness of the concrete, to obtain the required groove depth.

To afford a slight degree of vertical adjustment in the direction in which the pole handle 92 extends relative to the plane P of the tines 38 when the broom C′ is held in pavement texturing position, in order to permit adjustment of the working angle a to the desired inclination within the limits specified above, the handle 92 may be mounted on the header board 28 by means of an adjustable bracket means 94 as shown, for example, in FIG. 7. The bracket means 94 may comprise a collar member 96 in which one end of the pole handle 92 is suitably fastened as by screws, for example, and which is hingedly mounted on the header board 28 for a limited degree (e.g., 10° or so) of pivotal adjustment of the pole handle, in a plane parallel to the tines 38 and normal to the plane P thereof, from a position in a plane D approximately parallel to the plane P to a plane D' diverging from the plane P at an angle b of from 5° to 10° or so relative thereto. The pivotal mounting of the handle-holding collar 96 on the header board 28 may be provided by a conventional hinge member 98 the respective leaves 100 and 102 of which are suitably fastened to the collar member 96 and header board 28, respectively, as by means of screws or bolts, and the pivot axis 104 of which extends parallel to the plane P of and transversely to the tines 38. The pivotal adjustment of the handle 92 on the header board 28 may be provided by a pair of adjustment nuts 106, 108 screw-threaded onto an adjustment screw 110 passing through a slot 112 in the swing leaf 100 of the hinge member 98 and suitably secured to the header board as by being screw-threaded thereinto, for example. The adjustment nuts 106, 108 are located on opposite sides of the swing leaf 100 of the hinge member 98 so that by adjusting the nuts 106, 108 along the adjustment screw 110, and screwing them up tight against the opposite sides of the hinge leaf 100, the pole handle 92 may be set in the desired predetermined angular position relative to the plane P of the tines 38. Obviously, other pivotal mounting means for the pole handle 92 on the broom header board 28 may be employed such as, for example, complimentary toothed ring members mounted on the respective handle and header board members and clamped together with their teeth in selected meshed interengagement by suitable fastening means, such as a clamping bolt, to lock the handle and header board members in the desired adjusted angular position relative to one another.

By constructing the manually manipulated texturing broom C' in the above described manner so that the tines 38 are supported at the aforementioned shallow working angle b of about 10° to 15° or so relative to the pavement surface 10 when the broom is held in normal hand-held working position by a workman during its use to texture pavement surfaces, the same advantages of reduced distortion of the tines 38 or separation thereof from the header board 28 such as are realized with the machine manipulated broom C are also obtained, and more uniform textured pavement surfaces 10 are produced throughout a considerably longer service life of the broom. Also, because of the abovementioned shallow working angle b of the tines 38 relative to the pavement surface 10 and the use of the more durable tines, the workman can exert the required increased downward pressure on the broom C' and its tines 38, as necessitated by the varying degree of viscosity or stiffness of the pavement surface 10, to produce the required depth grooves 16 therein.

Having thus described the invention the following is claimed:

1. In apparatus for forming shallow texturing grooves in the surface of freshly laid uncured concrete pavement, said apparatus including a horizontally extending endless conveyor belt movable to carry a texturing broom mounted thereon across the pavement surface to be textured to form the said grooves therein, said broom including a header board having a row of straight spring steel tines projecting equidistantly therefrom in spaced apart side-by-side parallel relation and disposed in a common plane, the improvement comprising: mounting means including hinge means supporting said broom on said belt for pivotal movement thereon about a horizontal axis normal to the direction of travel of the belt with the said row of tines disposed transversely across the belt and the tines extending from said header board in a direction outwardly of the belt and parallel to the longitudinal vertical plane thereof; and spring means biasing said pivoted broom forwardly of the direction of travel of said belt toward a limiting pivoted idle position with the said tines extending in a direction generally perpendicularly outward of said belt, said mounting means supporting said broom in a predetermined position on said belt relative to the surface of said pavement to locate the broom in a rearwardly upward pivoted working position on said belt, during the travel of the broom along the lower horizontal run of said belt, with the said tines trailing and disposed at a shallow working angle relative to the pavement surface and with the free ends of the tines spring pressed into engagement with and depressed into the pavement surface to form the said grooves therein.

2. Apparatus as specified in claim 1 wherein the said working angle of the said tines relative to the surface of the pavement to be textured is less than about 20°.

3. Apparatus as specified in claim 1 wherein the said working angle of the said tines relative to the surface of the pavement to be textured is in the range of about 10° to 15°.

4. Apparatus as specified in claim 1 wherein a pair of said texturing brooms is supported on said conveyor belt equidistantly apart along the length thereof each by a separate said mounting means.

5. Apparatus as specified in claim 1 wherein said mounting means comprises a support bracket mounted on said belt and said hinge means comprises common double leaf hinge means having the respective leaves thereof secured to said bracket and to said broom header board.

6. Apparatus as specified in claim 3 wherein the pressure of the said spring means biasing said broom pivotally downward and forward when in its said working position is sufficient to depress the free ends of said tines downwardly into the said uncured pavement surface to a depth of around $\frac{1}{8}''$ to form grooves therein of corresponding depth.

7. Apparatus as specified in claim 5 wherein said spring means comprises an adjustable torsion helical gate spring fixedly secured at its opposite ends to said bracket and said broom header board at opposite sides of the hinge axis of said hinge means.

8. In apparatus for forming shallow texturing grooves in the surface of freshly laid uncured concrete pavement confined within side form members, said apparatus including a horizontally extending endless conveyor belt movable to carry a texturing broom mounted thereon across the pavement surface to be textured to form the said grooves therein, said broom includng a header board having a row of straight spring steel tines projecting equidistantly therefrom in spaced apart side-by-side parallel relation and disposed in a common plane, the improvement comprising: mounting means including hinge means supporting said broom on said belt for pivotal movement thereon about a horizontal axis normal to the direction of travel of the belt with the said row of tines disposed transversely across the belt and the tines extending from said header board in a direction outwardly of the belt and parallel to the longitudinal vertical plane thereof; spring means biasing said pivoted broom forwardly of the direction of travel of said belt; and adjustment means on said mounting means engageable with said broom to set it in a predetermined limiting pivoted idle position on said belt with the said tines extending in a direction generally perpendicularly outward of said belt; said mounting means supporting said broom in a predetermined position on said belt relative to the surface of said pavement to engage with and be pivoted rearwardly upward, by the one of said form members at the leading end of the pavement to be traversed by the broom during its travel along the lower horizontal run of said belt, from its said pivoted idle position to an operative working position with the said tines trailing and disposed at a shallow working angle relative to the pavement surface for spring pressed engagement of the free ends of the said tines with the pavement surface to form the said grooves therein.

9. Apparatus as specified in claim 8 wherein said adjustment means comprises an adjustment bolt in screw-threaded engagement with said bracket and projecting therefrom for engagement with the heel end of said broom header board opposite the end thereof from which the said tines project, to limit the forward pivoted movement of said broom by said spring means and set the broom in the said predetermined limiting pivoted idle position on said belt.

10. Apparatus as specified in claim 8 wherein the said working angle of the said tines relative to the surface of the pavement to be textured is in the range of about 10° to 15°.

11. A texturing apparatus for surface texturing freshly laid uncured concrete road surfaces, said apparatus comprising an elongated body member having a lower edge with a given width, a handle extending from said body member in a given direction, a plurality of spaced, elongated, spring steel tines supported on said body member on said edge thereof in a row extending transverse to said given direction and with the tines extending from said body member in a direction generally opposite the said given direction, said tines having a generally rectangular transverse cross-section with flat parallel surfaces, means for clamping said tines against said edge in a direction perpendicular to said flat surfaces and means, separate from said clamping means, for rigidifying said tines with respect to said edge.

12. An apparatus as defined in claim 11 wherein said clamping means is a metal fastening strap disposed along said body member adjacent said edge and extending across and overlying each of said tines and fastening means securing the said metal strap to said body member on each side of each of said tines to securely clamp the tines to and in place on said body member.

13. An apparatus as defined in claim 12 wherein said rigidifying means is a hardened mass of adhesive filling the spaces between the said fastening strap and said body member and extending along each side of each one of said tines to retain the tines in position.

14. An apparatus as defined in claim 11 wherein said handle comprises a pole-shaped member secured at one end to said body member by an adjustable mounting means affording adjustment of the angle at which said pole-shaped member extends relative to the plane of the said row of tines.

15. An apparatus for surface texturing freshly laid uncured concrete road surfaces, said apparatus comprising: an elongated header board having a side edge, a plurality of elongated straight extending spring steel tines each supported at one end on said header board to project approximately equidistant from the said side edge thereof in side-by-side spaced apart parallel relation to each other and disposed in a common plane, a metal fastening strap disposed along the said header board adjacent the said side edge and extending across and overlying the said one end of each of said tines, and fastening means securing the said metal strap to said header board on each side of each of said tines to securely clamp the said tines to and in place on the said header board, means, separate from said strap, for rigidifying said tines, and broom supporting means fastened to said header board for supporting the said tines thereon in an operative pavement texturing position with the said plane thereof disposed at a shallow working angle to the surface of the pavement.

* * * * *